United States Patent [19]

Hohenwarter et al.

[11] Patent Number: 4,870,830

[45] Date of Patent: Oct. 3, 1989

[54] CRYOGENIC FLUID DELIVERY SYSTEM

[75] Inventors: Gert K. G. Hohenwarter, Madison, Wis.; John A. Grange, Brooklyn, N.Y.

[73] Assignee: Hypres, Inc., Elmsford, N.Y.

[21] Appl. No.: 101,763

[22] Filed: Sep. 28, 1987

[51] Int. Cl.[4] ..... F17C 7/02

[52] U.S. Cl. ..... 62/50.7; 62/295; 62/51.1

[58] Field of Search ..... 62/55, 295, 514 R

[56] References Cited

U.S. PATENT DOCUMENTS

| | | | |
|---|---|---|---|
| 1,769,087 | 7/1930 | Vucassovich | 62/64 |
| 2,261,808 | 11/1941 | Morris | 99/195 |
| 2,470,245 | 5/1949 | Green | 49/89 |
| 2,988,898 | 6/1961 | Hesson et al. | 62/168 |
| 3,079,504 | 2/1963 | Hutchens | 250/83 |
| 3,083,547 | 4/1963 | Stevens et al. | 62/374 |
| 3,364,689 | 1/1968 | Johnson | 62/55 |
| 3,431,749 | 3/1969 | Bounds et al. | 62/293 |
| 3,433,028 | 3/1969 | Klee | 62/55 |
| 3,456,451 | 7/1969 | Roberson, Jr. | 62/55 |
| 3,466,886 | 9/1969 | Doose et al. | 62/55 |
| 3,696,627 | 10/1972 | Longsworth | 62/51 |
| 3,706,208 | 12/1972 | Kadi et al. | 62/55 |
| 3,783,628 | 1/1974 | Reiche | 62/55 |
| 3,894,403 | 7/1975 | Longsworth | 62/55 |
| 3,946,572 | 3/1976 | Bragg | 62/55 |
| 3,991,587 | 11/1976 | Laskaris | 62/55 |
| 4,190,106 | 2/1980 | Dunmire et al. | 165/185 |
| 4,277,950 | 7/1981 | Eigenbrod et al. | 62/55 |
| 4,299,091 | 11/1981 | Carter et al. | 62/55 |
| 4,450,693 | 5/1984 | Green et al. | 62/514 R |
| 4,459,823 | 7/1984 | Josephs et al. | 62/268 |
| 4,498,046 | 2/1985 | Faris et al. | 324/158 F |

OTHER PUBLICATIONS

Air Products & Chemicals, Inc., "Model LT-3-110 Liquid Transfer Heli-Tran Refrigerators—Operating Manual".

Air Products & Chemicals, Inc., "Models LT-3-110 and LT-3B-110 Heli-Tran Liquid Transfer Refrigeration Systems", Technical Manual, Sep. 1984.

Siefert, H., "Liquid Helium Cooled Sample Stage for Scanning Electron Microscope", Jul. 15, 1982.

Moskowitz, P. A., et al., "Cryosampler Interface", IBM Research Report, RC 9614 (#42408), 10/1/82.

Moskowitz, P. A., et al., "Superconducting Electronics Testing", IBM Research Report, RC 9519 (#42090), 8/18/82.

*Primary Examiner*—Ronald C. Capossela

*Attorney, Agent, or Firm*—Kenyon & Kenyon

[57] ABSTRACT

A system for delivering a cryogenic fluid to cool devices, such as electronic devices, in an open-cycle environment. The system comprises a dewar which stores a cold fluid, a cryogenic module for holding a device to be cooled and a cold fluid transfer line which delivers the cold fluid from the dewar to the device within the cryogenic module. The system further comprises an interlock mechanism to hold the transfer line and the dewar securely together and a coupling mechanism to allow the transfer line to securely engage the cryogenic module. The system also comprises a control subsystem which monitors and controls the flow of cold fluid from the dewar and through the transfer line.

21 Claims, 4 Drawing Sheets

CRYOGENIC FLUID DELIVERY SYSTEM

TECHNICAL FIELD

The invention relates generally to apparatus for cooling devices to cryogenic temperatures. In particular, the invention relates to apparatus for delivering cryogenic fluids to cool electronic devices in an open-cycle environment.

BACKGROUND OF THE INVENTION

In order to use superconducting technologies to measure electrical waveforms produced by room temperature devices, or indeed to interface any low temperature electronic device to a room temperature electronic device, the interface mechanism must satisfy certain electrical, mechanical, and temperature constraints. Co-pending patent application No. 796,842, filed on Nov. 11, 1985 now U.S. Pat. No. 4,715,189, which is related to the present invention, discusses the aforementioned constraints and attempts of the prior art to satisfy them. The invention described and claimed in the above co-pending patent application obviates the problems of the prior art mechanisms.

Existing apparatus which actually deliver cold fluids to a sample to be cooled also have numerous drawbacks that must be overcome. One example of existing product used in the field of optics to cool devices is known by the trademark Heli-Tran and made by APD Cryogenics, Inc., Allentown, PA.

The Heli-Tran comprises a mounting head enclosed in an evacuated space for holding a sample to be cooled, and a multi-channel flexible transfer tube for connecting the mounting head to a dewar of liquid helium. The descriptive literature appears to show that the transfer tube comprises a forward helium flow capillary (from the dewar to the mounting head), a shield tube surrounding the forward helium flow capillary, and a separate return flow capillary for the spent fluid. When the dewar is pressurized, liquid helium flows through both the forward helium flow capillary and the shield tube into the mounting head. The helium in the capillary strikes the inside surface of a metal block closing off the end of the transfer tube, then enters a passage coaxially surrounding all the transfer tube elements, travels a short distance in the return direction, and exits through a helium exhaust port. The helium in the shield tube turns back at the metal block, enters the return flow capillary, and exits from a shield flow return port near the dewar. The sample holder is attached to the outside of the metal block so that it can conduct heat from the sample to be cooled to the metal block, which in turn is cooled by the helium in the forward flow capillary.

The primary drawbacks with the Heli-Tran system are that the mounting head is entirely enclosed in a vacuum shroud, rendering sample demounting difficult and cumbersome and that the descriptive literature suggests total immersion of the samples, e.g., a superconducting electronic circuit, contributing to inefficient liquid helium consumption.

SUMMARY OF THE INVENTION

The foregoing problems are obviated by the present invention which comprises:

first means for storing a cryogenic fluid;

second means for holding a device to be cooled;

third means for transferring the cryogenic fluid to the second means;

fourth means for adaptively interlocking the first means and the third means; and fifth means for coupling the second means and the third means.

The cryogenic fluid delivery and cooling system may further comprise a control means for providing a controlled flow of the cryogenic fluid from the first means to the third means.

In a system including a control means, the control means may comprise a sensing means for detecting the pressure in the first and third means; pressurizing means, responsive to the sensing means, for increasing the pressure in the first means; and means, responsive to the sensing means, for reducing the pressure in the first means if the pressure in the first means exceeds a predetermined threshold as detected by the sensing means.

The third means for transferring cryogenic fluid to the second means may comprise a delivery conduit for carrying the cryogenic fluid to the device and means for insulating the conduit and for minimizing heat exchange with the environment surrounding the delivery conduit. The insulating means may comprise an evacuated conduit surrounding the delivery conduit and a means for evacuating the evacuated conduit.

The cryogenic fluid delivery and cooling system may also comprise a means for controlling the fifth means which couples the second and third means to automatically pull the second and third means into a secure connection with one another. The fifth means may comprise a grappling mechanism which automatically pulls the second and third means into a secure connection with one another.

BRIEF DESCRIPTION OF THE DRAWINGS

For a better understanding of the invention, reference is made to the following description of an exemplary embodiment thereof, and to the accompanying drawings, wherein.

DETAILED DESCRIPTION

Figure 1:
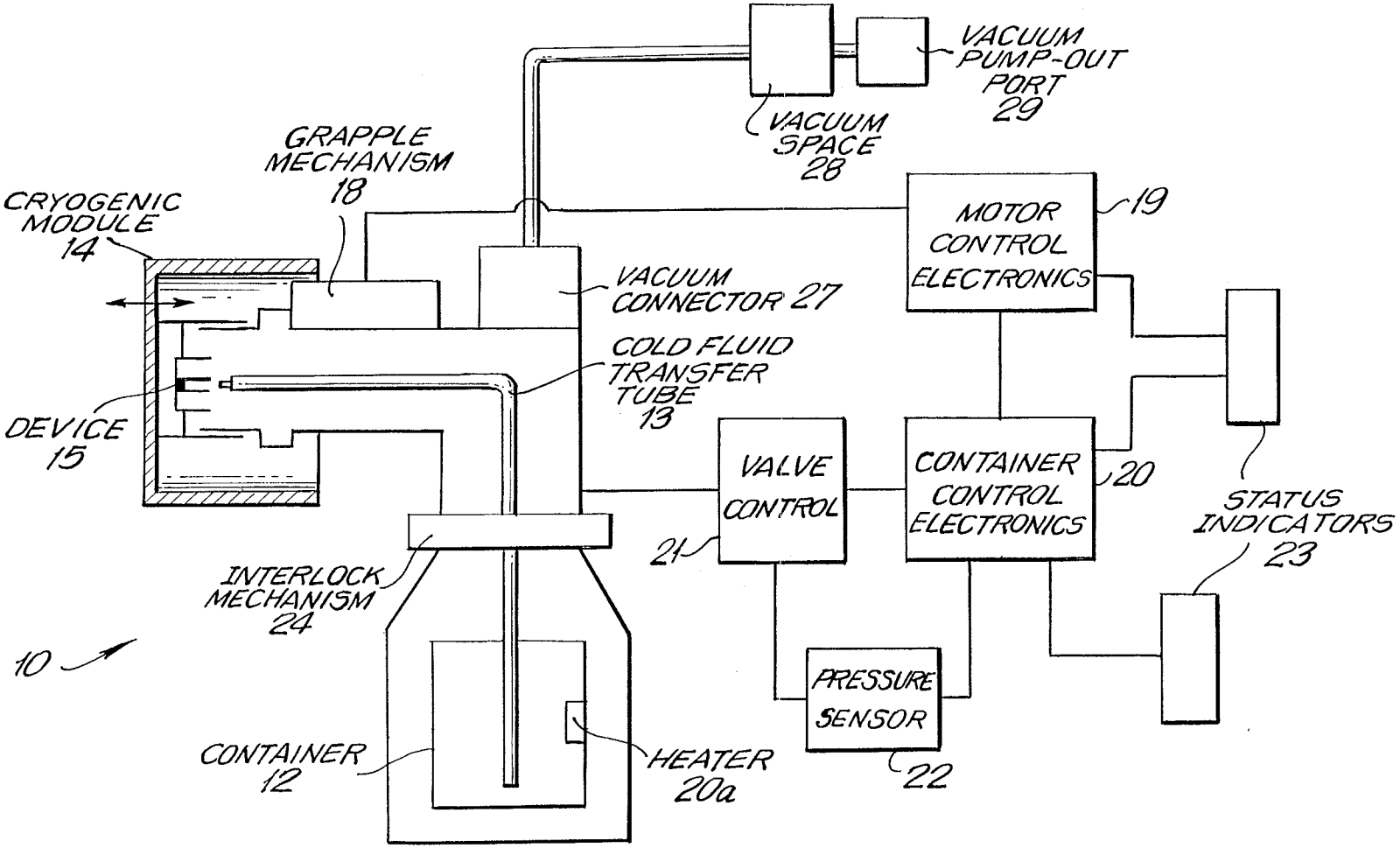
FIG. 1 is a schematic representation of a cryogenic fluid delivery system of the present invention.

FIG. 1 is a schematic representation of a cryogenic fluid delivery and cooling system 10 of the present invention. The system 10 comprises an insulated liquid/fluid container 12, such as a dewar, removably connected to one end of a cold fluid transfer tube 13. The container 12 stores a cold fluid, such as liquid helium or nitrogen, and is structured to withstand the pressurization of such fluid during system operations. The cold fluid transfer tube 13 has a second end which, during operation of the system 10, becomes coupled to a cryogenic module 14 functioning as a cooling chamber and for holding a device 15 to be cooled. A device 15 to be cooled, which can be, for example, an electronic circuit fabricated on a substrate, is mounted on an interior surface of the cryogenic module 14 and aligned with the second end of the transfer tube 13 when the tube is coupled to the module.

The cryogenic module 14 is coupled to the second end of the transfer tube 13 by a motor-operated grapple mechanism 18. The grapple mechanism 18 is located at the second end of the transfer tube 13 and, although a separate element apart from the tube, may be encased in the same exterior frame structure so as to appear as a unitary body with the tube 13. Alternatively, the second end of the transfer tube 13 may be made integral with the mechanism 18 which would then form an end portion thereof. The grapple mechanism 18 can be similar in operation to the mechanisms used in conjunction with loading video tapes into video cassette recorders whereby the cryogenic module 14, or a portion thereof, is inserted into an opening of the mechanism 18 and automatically pulled into coupling with the transfer tube 13. The module 14 and the second end of the transfer tube 13 are securely connected to one another by the grapple mechanism 18 during the operation of the system 10. Motor control electronics 19 regulate the motor (not shown) of the grapple mechanism 18. Note that the grapple mechanism 18 can be constructed as a manual device which performs the same function and thus obviate the need for a motor and motor control electronics.

The system 10 further comprises container control electronics 20 which monitor and adjust the flow of cold fluid, so as to provide a controlled flow of fluid, from the container 12 into the cold fluid transfer tube 13 and toward the cryogenic module 14. The container control electronics 20 accomplish this control by electronically driving a heater **20*a* within the container 12 which pressurizes the container 12 interior by evaporating a portion of the cold fluid. Alternatively, the container control electronics 20 can accomplish this control by electronically driving a pump to pressurize the container 12 interior. Note that the heater 20*a* may instead be integrated with the cold fluid transfer tube 13 within the container 21. The container control electronics 20 also drive a valve control 21 to open up the container 12 to the outside air to reduce the pressure developed within the container 12 over a threshhold pressure that is necessary for minimal operation. The valve control 21 may also be used to occassionally vent the container 12 of the build-up of vapor "boiled off" the cold fluid in steady-state. Both the valve control 21 and the container control electronics 20 use a pressure sensor 22 to monitor the pressure in both the container 12 and in the cold fluid transfer tube 13. Note that both the motor control electronics 19 and the container control electronics 20 may be equipped with status indicators 23. The status indicators 23 are used to inform users/operators of the system 10** of certain operating conditions.

The system 10 also comprises an interlock mechanism 24, the primary purpose of which is to connect the container 12 with the first end of the cold fluid transfer tube 13. The interlock mechanism 24 also functions, however, as a safety feature for the system 10. During normal system operation, the pressure of the cold fluid in both the container 12 and the transfer tube 13 is regulated by the container control electronics 20. However, if the system 10 begins operating far beyond the correct operating pressure in either the container 12 or the transfer tube 13 and the control electronics 20 fail to adjust the cold fluid pressure, the interlock mechanism 24 will open up an additional passage between the container 12 and the outside environment. Thus, in those circumstances, the interlock mechanism 24 provides a reserve method of relieving unusually high pressure build-up. The interlock mechanism 24 can be constructed either as a separate device to be attached to both the transfer tube 13 and the container 12 or integral to either element.

Finally, the system 10 comprises a vacuum connector 27 which connects the cold fluid transfer tube 13 with a vacuum space 28 and a vacuum pump-out port 29. As will be discussed later, the cold fluid transfer tube 13 is configured to utilize vacuum spaces to insulate the cold fluid delivered to the cryogenic module 14. The vacuum connector 27, the vacuum space 28, and the vacuum pump-out port 29 function to establish and maintain the vacuum in those spaces.

Figure 2:
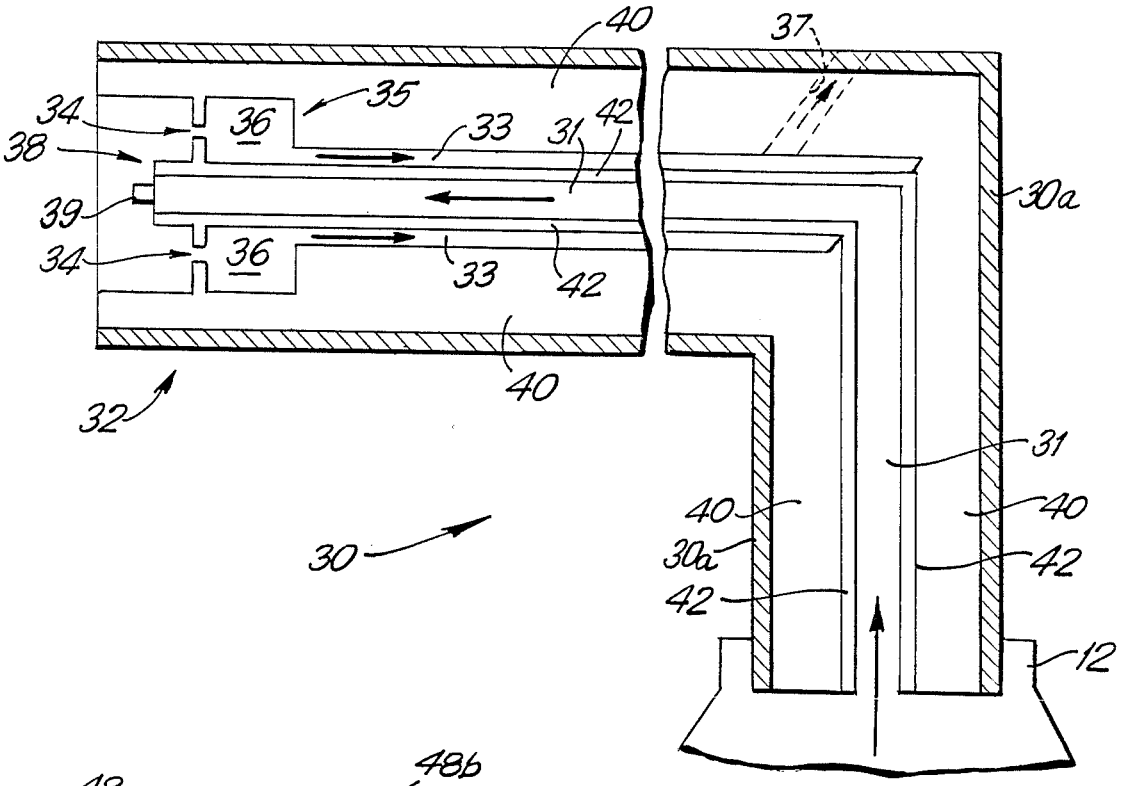
FIG. 2 is a cut-away view of a cold fluid transfer tube of the delivery system of FIG. 1.

FIG. 2 shows a cut-away view of a cold fluid transfer tube 30 of the delivery system 10. The cold fluid transfer tube 30 is composed of an outer body **30*a* which may be of rigid or flexibile construction depending on the system 10 application. The outer body 30*a* encloses two coaxial channels, a delivery channel 31 which carries the cold fluid from the container 12 to a free end 32 of the transfer tube 30 and a return channel 33 surrounding the delivery channel 31 which receives spent fluid from the cryogenic module 14 through an annular opening 34 at a free end 35 of the return channel 33. The free end 35 of the return channel 33 is flared so as to form a chamber 36 which may be of any configuration, for example, annular. The return channel 33 vents the spent fluid from the chamber 36 through the cold fluid transfer tube 30 and into the open air, or into a recycling apparatus and back to the container 12, via an exhaust port 37 formed in the return channel 33 and the outer body 30*a*. The exhaust port 37 may also be connected to a vacuum pump which can control the fluid flow through the system 10 as an alternative to the heater 20*a* or a container 12 pump. Note, as shown in FIG. 2, the delivery channel 31 extends beyond the return channel 33 at the free end 32 of the transfer tube 30. The free and extended end 38 of the delivery channel 31 can form a nozzle 39 which need not be of any particular shape, and may be merely the cut-off end of the channel. Also note, that the outer body 30*a* may also enclose an additional channel (not shown) which can be used by the valve control 21 to open up the container 12** to the outside environment and reduce the pressure developed therein or vent any vapor build-up.

The transfer tube 30 also comprises a first vacuum space 40 between the outer body **30*a* and the return channel 33 which insulates the return channel 33 and the delivery channel 31 from the outside air or environment. A second vacuum space 42 is also provided between the delivery channel 31 and the return channel 33 to insulate the delivery channel 31 from the return channel 32 which contains warmed fluid after operation of the system 10. Alternatively, the vacuum spaces 40, 42 may be replaced with an insulating material which prevents any substantial heat transfer between the delivery channel 31, the return channel 33**, and the outside environment.

Figure 2A:
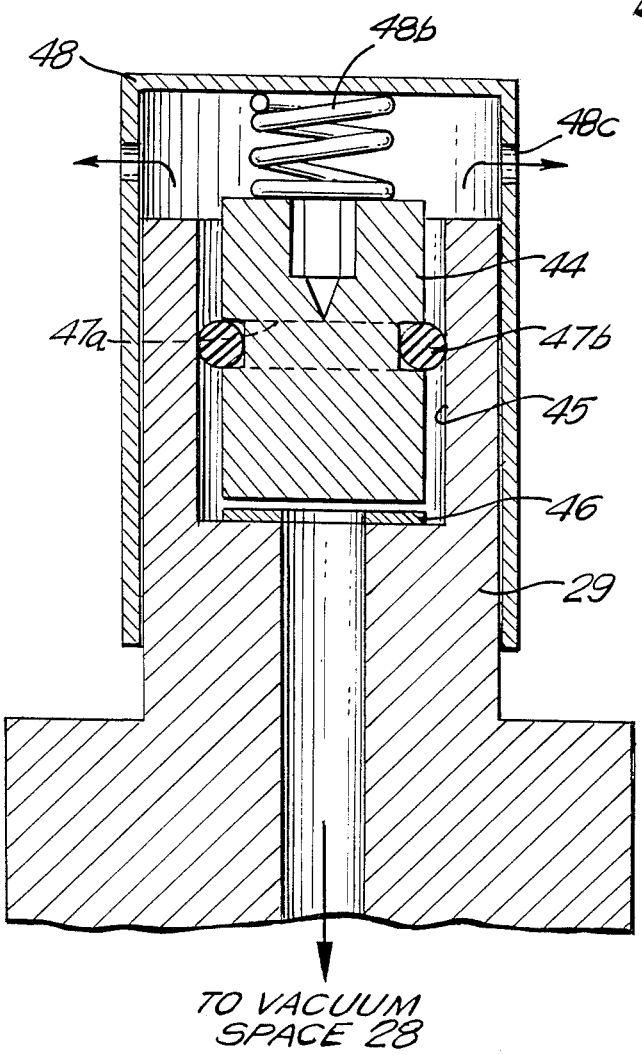
FIG. 2*a* is a cut-away view of a vacuum pump-out port and associated shut-off valve of the delivery system of FIG. 1.

The vacuum in the vacuum spaces 40, 42 is established initially during system manufacture by a vacuum pump connected to the vacuum pump-out port 29. After system manufacture, the vacuum pump is removed and replaced with a shut-off valve 44, such as is shown in FIG. 2*a*. In the embodiment shown, the shut-off valve 44 is shaped and sized to fit within a flared opening 45 formed at one end of the vacuum pump-out port 29, a portion of which is configured as a hollow elongated cylinder. The valve 44 rests on an annular metal gasket 46, which is not easily permeated by helium, within the flared opening 45. The valve 44 has an annular groove 47*a* formed on its surface to accommodate an o-ring 47*b* which helps the valve 44 seal the passageway to the vacuum space 28. A cap 48 is sized and shaped to fit over the portion of the port 29 configured as an elongated cylinder. A spring mechanism 48*b* is situated between the cap 48 and the valve 44 sitting in the flared opening 45, said spring mechanism 48*b* pressurizing the valve 44. The cap 48 also has side openings 48*c* which form a passage between the outside environment and the interior space between the cap 48 and the valve 44 and port 29. The cap 48 and spring mechanism 48*b* act to maintain positive pressure on the gasket 46 and also provide an emergency relief path for pressure disturbances occurring in the vacuum space 28. Note that the outside surface of the port 29 may have a thread to accommodate an attachment of the vacuum pump for evacuation of the vacuum spaces 40, 42 during system manufacture and during subsequent maintenance routines.

Figure 3:
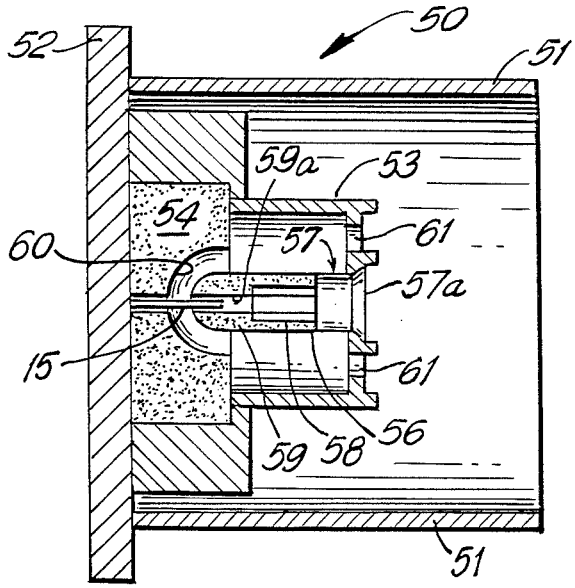
FIG. 3 is a cut-away view of a cryogenic module of the delivery system of FIG. 1.

FIG. 3 shows a cut-away view of a cryogenic module 50 of the delivery system 10. The cryogenic module 50 is formed by a rigid exterior frame 51 which is closed at one end of its length by a removable device holder 52. The device 15 to be cooled, which can be, for example, an electronic circuit fabricated on a substrate, is mounted on the surface of the device holder 52 lying within the module 50. The other end of the exterior frame 51 is open and sized to receive the free end 32 of the cold fluid transfer tube 30.

The device holder 52 is secured against the exterior frame 51 by being removably fastened to a rigid enclosure 53 formed within the cryogenic module 50 coaxially to the exterior frame 51. At the end fastened to the device holder 52, the enclosure 53 surrounds the device 15 and, at the other end, the enclosure 53 is configured to adaptively couple with the free end 38 of the delivery channel 31 as shown in FIG. 5. The device 15 is disposed in a slit within an insulating material 54 formed within the enclosure 53 at the fastened end. The insulating material 54 is shaped to permit the portion of the device 15 that is desired to be cooled to protrude from the insulating material 54 toward the other end of the enclosure 53. The enclosure 53 thus defines a general pathway between the device 15 and the delivery channel 31 and also functions as an interlocking mechanism. Note that the exterior frame 51 and the enclosure 53 may be lined with an insulating material 55, such as teflon or styrofoam.

An alignment guide 56 may also be disposed within the enclosure 53, between the device 15 and the end of the enclosure 53 that couples with the delivery channel 31. One such guide 56 is shown in FIG. 3. The guide 56 is configured to adaptively receive and hold the free and extended end 38 of the delivery channel 31 and comprises three components: a receptacle 57, an input tube 58, and a cap 59 made of insulating material. The receptacle 57, which includes a frontal boss 57*a*, is the first component of the guide 56 that the delivery tube 31 engages and, as such, it is shaped and sized to receive the free and extended end 38 of the delivery tube 31. The receptacle 57 is rotatably secured to the enclosure 53 at the frontal boss 57*a* to permit rotation through 360 degrees. The input tube 58 is connected at one end of its length to the end of the receptacle 57 opposite the boss 57*a* and is shaped and sized to receive the nozzle 39 of the delivery channel 31. The other end of the input tube 58 remains free and, as shown in the embodiment illustrated by FIG. 3, is positioned directly opposite the device 15 to be cooled. However, depending on the application and the device 15 configuration, the positional relationship between the two elements can be different. The insulating cap 59 surrounds both the input tube 58 and the portion of the device 15 that is desired to be cooled establishing a passageway 59*a* between the free end of the input tube 58 and the device 15. The insulating cap 59 does not contact the insulating material 54 so that a channel 60 is formed therebetween. The channel 60 leads to the remainder of the interior space of the enclosure 53 which is unfilled and which, in turn, leads to an annular opening 61 at the end of the enclosure 53 that couples with the delivery channel 31. The annular opening 61 is sized and shaped equal to the annular opening 34 of the free end 35 of the return channel 33.

Figure 4:
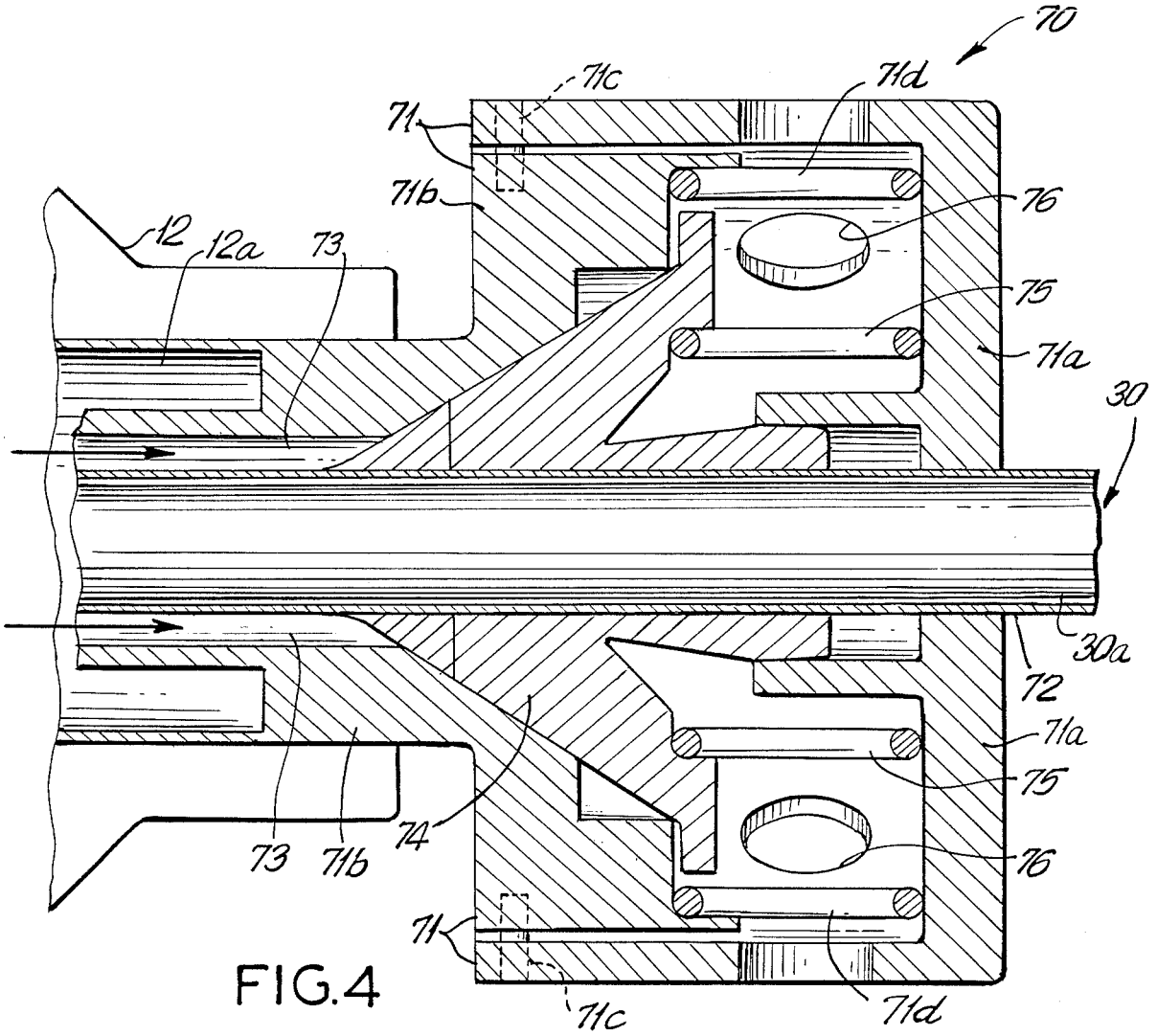
FIG. 4 is a cut-away view of an interlock mechanism between a cold fluid container and a cold fluid transfer tube of the delivery system of FIG. 1.

FIG. 4 shows a cut-away view of an interlock mechanism 70 whose primary purpose is to interlock the cold fluid transfer tube 30 with the cold fluid container 12. As discussed previously, however, the interlock mechanism 70 also acts as a back-up pressure release for the system 10.

The interlock mechanism 70 comprises a rigid bisectional frame 71 having a first portion 71*a* at one end of its length slidably connected to a second portion 71*b* at the other end of its length via a line of pins 71*c* secured to the first portion 71*a* and a channel (not shown) formed in the second portion 71*b*. A plurality of resilient members 71*d*, such as springs, are interposed between the two portions 71*a*, 71*b*. The frame 71 has a lengthwise opening 72 through its center for slidable passage therethrough of the cold fluid transfer tube 30. The opening 72 is shaped and sized to accommodate the transfer tube 30. The frame 71 may be fixably fastened to the outer body 30*a* of the transfer tube 30 or may be demountably fastened by any one of many different methods, for example, via an internal screw thread. Alternatively, the frame 71 may be integrally formed with the outer body 30*a* of the transfer tube 30. The frame 71 is configured at the second portion 71*b* to be adaptively engageable with engaging slots 12*a* of the container 12. The central opening 72 is flared at that second portion 71*b* such that a channel 73 is formed when the transfer tube 30 is situated within the central opening 72, said channel 73 providing passage from the interior of the frame 71 and the interior of the container 1 when the second portion 71*b* is adaptively engaged therein. Note that the frame 71 may instead be integrally formed, at the second portion 71*b*, with the exterior shell of the container 12.

A rigid sliding member 74 is disposed within the interior of the frame 71 and, in particular, coaxially surrounds the central opening 72 and the transfer tube 30 when that tube is situated therein. The dimensions of the sliding member 74 are smaller than those of the interior of the frame 71 so as to allow the member 74 to undergo lengthwise movement along the axis of the central opening 72. In its rest position, the sliding member 74 presses against the second portion 71*b* of the frame 71 which is adaptively engageable with the container 12 and seals the passageway into the frame 71 interior formed by the channel 73 around the end of the transfer tube 30. At the other end of its length, the sliding member 74 is shaped to hold a plurality of resilient members 75, such as springs, against the interior wall of the first portion 71*a* of the frame 71. The spring constant of the resilient members 75 are selected such that, in the rest position of the sliding member 74, the resilient members 75 force the sliding member 74 to stay in intimate contact with the frame 71 at the second portion 71*b* adaptively engageable with the container 12. The interlock mechanism 70 also comprises an exhaust port 76, which can be formed within the first portion 71*a* of the frame 71, connecting the interior of the frame 71 not occupied by the sliding member 74 in its rest position, i.e., in the vicinity of the resilient members, and the open air or surrounding environment.

Once the transfer tube 30 is situated in the central opening 72, the interlock mechanism 70 is operated by rotating the first portion 71*a* of the frame 71 about the second portion 71*b*, via the pin-channel mechanism, a predetermined amount of degrees and pushing the second portion 71*b*, with the transfer tube 30, down into the engaging slots 12*a* of the container 12. The channel is so configured that when the first portion 71*a* is turned back, the first portion 71*a* may engage a portion of the channel formed at some angle to the path of rotation and snap into a secure connection with the second portion 71*b*. The plurality of resilient members 71*d* between the two portions 71*a*, 71*b* become depressed and seal the mechanism 70 in place with an o-ring. The container 12 and the transfer tube 30 are then securely connected together.

If the system 10 is operating with the correct pressure, e.g., approximately 5 psi, in the container 12 and in the cold fluid transfer tube 30, the interlock mechanism 70 and, in particular, the sliding member 74 will remain in a rest position. The pressure within the container 12 forces the cold fluid into the delivery channel 31 of the transfer tube 30 as well as the channel 73. However, the cold fluid in the channel 73 does not exert sufficient force on the sliding member 74 to overcome the force of the resilient members 76 acting in the opposite direction and, thus, move the sliding member 74. When the pressure reaches a predetermined pressure, for example, approximately 10 psi, the sliding member 74 is forced away from the second portion 71*b* of the frame 71, the force of the resilient members 76 on the member 74 now being overcome by the cold fluid under the relief pressure acting in the opposite direction. This now allows the channel 73 to be unsealed and the passageway between the interior space of the frame 71 and the interior of the container 12 to be reconnected. The cold fluid, which is under unusually high pressure, passes quickly from the container 12 through the channel 73 and into the interior of the frame 71. Once inside, the cold fluid exits immediately into the open air via the exhaust port 76. Consequently, the system 10 is relieved of the pressure build-up without damage to the system 10 or to the surrounding environment. A system operator/user upon learning of the pressure build-up via the status indicators 23, or a visual inspection of the system 10, can then take the appropriate steps to correct the problem or shut the system 10 down.

Figure 5A:
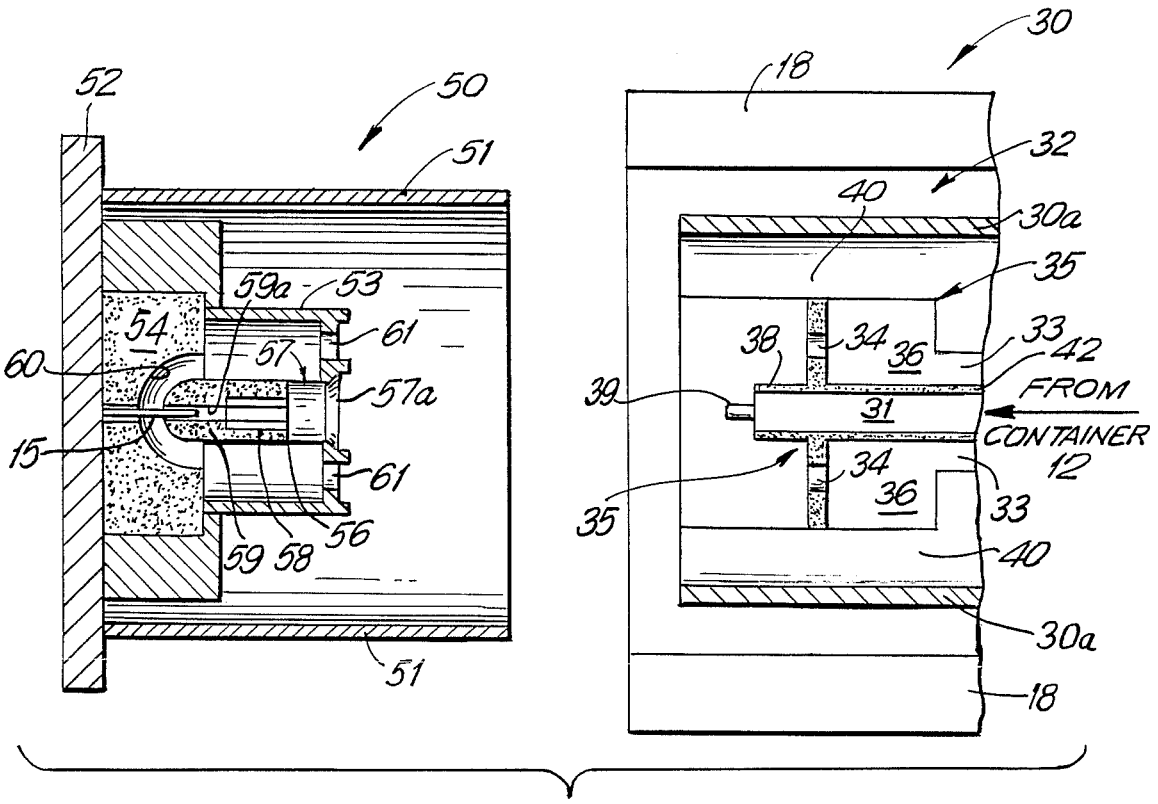
FIG. 5*a* is a cut-away view of a cold fluid transfer tube and a cryogenic module of the delivery system of FIG. 1 in an uncoupled position.
Figure 5B:
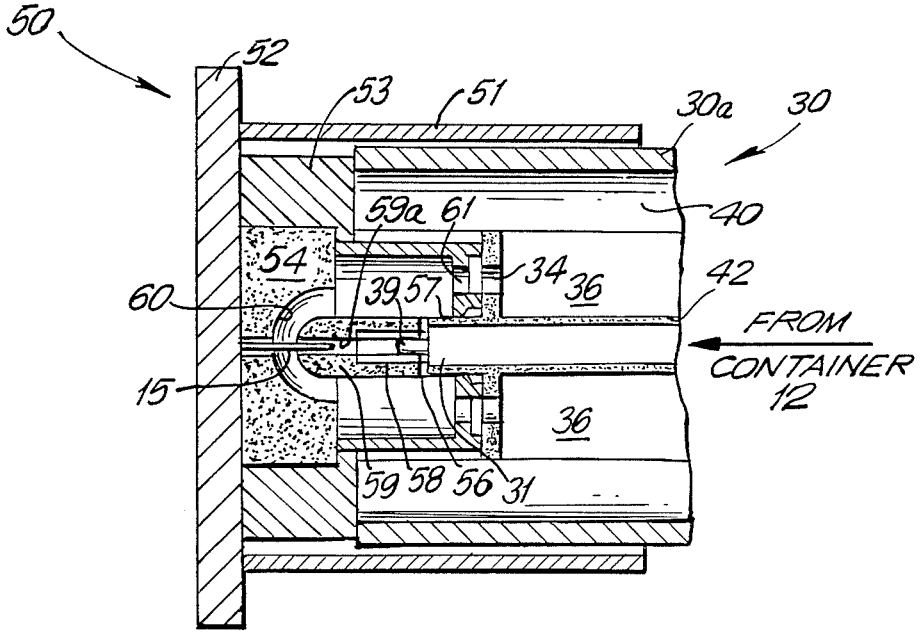
FIG. 5*b* is a cut-away view of a cold fluid transfer tube and a cryogenic module of the delivery system of FIG. 1 in a coupled position during operation of the system.

FIG. 5*a* shows the cryogenic module 50 and the cold fluid transfer tube 30 of the system 10 in an uncoupled position before system operation. Note that the grapple mechanism 18 is shown surrounding the free end 32 of the cold fluid transfer tube 30. FIG. 5*b* shows the cryogenic module 50 and the cold fluid transfer tube 30 in a coupled position during the system 10 operation. In operation, the cryogenic module 50 is positioned near the free end 32 of the cold fluid transfer tube 30 within an end opening of the grapple mechanism 18. The motor control electronics 19 activate the mechanism's motor which, in turn, drives the grapple mechanism 18 into operation. The electronics 19 may activate the motor via, for example, push-button control or a sensor which detects the module 50 entry. The grapple mechanism 18, when driven, then pulls the cryogenic module 50 toward the transfer tube 30 so that the free end 38 of the delivery channel 31 becomes inserted within the receiving end of the rigid enclosure 53 of the module 50. The pulling action of the mechanism 18 may be accomplished by any type of drawing element which exerts sufficient force on the frame 51 and captures the module 50 in a secure fashion.

The module 50 and the transfer tube 30 are securely coupled together so that the module 50 cannot be removed during operation. In this coupled position, the annular opening 61 of the enclosure 53 aligns with the annular opening 34 of the return channel 31. In addition, the free and extended end 38 of the transfer tube 30 engages the alignment guide 56 so that the nozzle 39 is inserted within the input tube 58 and the free and extended end 38 rests within the receptacle 57.

Upon the completion of the coupling stage, the motor control electronics 19 signal the container control electronics 20 to direct the container heater 20*a* to evaporate a portion of the cold fluid and pressurize the container 12. This forces the cold fluid within the container 12 to be carried through the delivery channel 31 of the transfer tube 30 and ejected from the nozzle 39. The cold fluid then passes into the module 50 and flows through the input tube 58 and the passageway 59*a* within the insulating cap 59 and strikes the portion of the device 15 that is desired to be cooled. The device 15 portion is thereby quickly cooled to cryogenic temperatures. Note that the container control electronics 20, the valve control 21, and the pressure sensor 22 operate in combination to regulate the pressurization of the container 12. In this way, the force and amount of cold fluid striking the device 15 can be maintained at a constant level or, if desired, can be varied during the operation. In addition, the temperature of the cold fluid can be varied within certain limits.

The spent fluid, then exits the passageway 59*a*, strikes the insulating material 54 across from the insulating cap 59 and, due to the shape of the insulating material 54, deflects into the open interior space of the enclosure 53 via the channel 60. The spent fluid exits the enclosure 53 through the annular opening 61 and enters the flared chamber 36 of the return channel 33 of the transfer tube 30 through the annular opening 34. Once inside the flared chamber 36, the spent fluid is carried back, via the return channel 33, through the transfer tube 30 to be either discarded via the exhaust port 37 or recycled. Note that the vacuum spaces 42, 44 within the transfer tube 30 prevent any substantial heat transfer between the delivery channel 31, the return channel 33, and the outside environment, thus, insuring that the temperature of the cold fluid being delivered to the device 15 to be cooled remains relatively stable.

The advantages of the present invention are several. First, the open-cycle configuration of the cryogenic module 50 permits easy replacement of the device 15 to be cooled. In contrast, the vacuum cooling chambers of the prior art require a relatively larger amount of associated apparatus and, consequently, are cumbersome during such replacements. The grappling mechanism 18 of the present invention facilitates device replacements by providing an apparatus to secure a stand-alone cryogenic module 50 with the cold fluid transfer tube 30 and, thus, permit the system 10 to enjoy a degree of modularity. Second, the present invention has many features to insure an efficient consumption of cold fluid, such as vacuum spaces, and associated vacuum apparatus, to insulate the delivery channel 31 and a control sub-system to regulate the pressurization of the cold fluid. Also, as discussed previously, the interlock mechanism 24 provides a pressure release safety feature.

It is to be understood that the embodiments described herein are merely illustrative of the principles of the invention. Various modifications may be made thereto by persons skilled in the art without departing from the spirit and scope of the invention. For example, the exemplary embodiment accommodates a single nozzle 38; however, it should be clear that the present invention can accommodate a plurality of nozzles from either a single transfer tube or several such tubes to cool a single device or a plurality of devices. In addition, multiple devices may also be cooled by the present invention. A multiplicity of devices may be mounted on the device holder 52, for example, side by side, in a radial fashion, or in a stacked fashion, and each cooled at the same time with one stream of cold fluid. Such embodiments may increase the efficiency of cold fluid consumption by the system 10.

Further, the various portions of the exemplary embodiment may be configured differently but perform the same respective functions. For example, the control of the cold fluid flow may be accomplished by the use of a helium pump sitting at the bottom of the container 12 rather than via the heater 20*a*. In addition, the cold fluid transfer tube 13 may have a capillary configuration of channels or a combination of capillary and coaxial channels. Also, the vacuum spaces 40, 42 of the transfer tube 13 may be made integral with any vacuum lining of the container 12.

What is claimed is:

1. A cryogenic delivery and cooling system, comprising:

first means for storing a cryogenic fluid; second means for holding a device to be cooled; third means for transferring the cryogenic fluid to said second means;

fourth means for adaptively interlocking said first means and said third means; and fifth means for drawing said second means into a coupled arrangement with said third means.

2. The system of claim 1, further comprising:

control means for providing a controlled flow of the cryogenic fluid from said first means to said third means.

3. The system of claim 1, further comprising:

sensing means for detecting the pressure in said first means and said third means;

pressurizing means, responsive to said sensing means, for increasing the pressure in said first means; and means, responsive to said sensing means, for reducing the pressure in said first means if the pressure in said first means exceeds a predetermined threshold as detected by said sensing means, said pressurizing means and said means for reducing the pressure acting in concert to provide a controlled flow of the cryogenic fluid from said first means to said third means.

4. The system of claim 1, further comprising:

control means for providing a controlled flow of the cryogenic fluid from said first means to said third means; and vent means for removing expended cryogenic fluid from said second means.

5. The system of claim 1, wherein said third means comprises:

a delivery conduit for carrying the cryogenic fluid to the device; and means for insulating said delivery conduit and for minimizing heat exchange with the environment surrounding said delivery conduit.

6. The system of claim 1, wherein said third means comprises:

a delivery conduit for carrying the cryogenic fluid to the device;

an evacuated conduit surrounding said delivery conduit for minimizing heat exchange with the environment external to said delivery conduit; and means for evacuating said evacuated conduit.

7. The system of claim 1, further comprising means for controlling said fifth means to automatically pull said second and third means into a secure connection with one another.

8. The system of claim 1, wherein said fifth means for drawing comprises a grappling mechanism to automatically pull said second and third means into a secure connection with one another.

9. A system for delivering a coolant to a device comprising:

first means for holding the device;

second means for storing the coolant;

third means for transferring the coolant to the device;

fourth means for adaptively interlocking said second means and said third means;

control means for providing a controlled flow of coolant from said second means into said third means;

fifth means for coupling said first means and said third means; and sixth means for controlling said fifth means.

10. The system of claim 9, wherein said control means comprises:

sensing means for detecting the pressure in said second means and said third means;

pressurizing means, responsive to said sensing means, for pressurizing said second means; and means, responsive to said sensing means, for reducing pressure in said second means if the pressure in said second means exceeds a predetermined threshold as detected by said sensing means.

11. The system of claim 9, wherein said means for transferring comprises:

a delivery conduit for carrying fluid to said first means; and means for insulating said delivery conduit and for minimizing heat exchange with the environment surrounding said delivery conduit.

12. The system of claim 9, wherein said means for transferring comprises:

a delivery conduit for carrying fluid to said first means; and means for insulating said delivery conduit and for minimizing heat exchange with the environment external to said delivery conduit, wherein said insulating means comprises an evacuated conduit surrounding said delivery conduit and means for evacuating said evacuated conduit.

13. The system of claim 9, wherein said means for transferring comprises:

a delivery conduit for carrying fluid to said first means; and means for insulating said delivery conduit and for minimizing heat exchange with the environment external to said delivery conduit, wherein said insulating means comprises an evacuated conduit surrounding said delivery conduit and means for evacuating said evacuated conduit; and wherein said fifth means comprises a grappling mechanism to automatically pull said first and third means into a secure connection with one another.

14. The system of claim 9, wherein said means for transferring comprises:

a delivery conduit for carrying coolant to said first means of the device; and means for insulating said delivery conduit and for minimizing heat exchange with the surrounding environment and wherein said control means comprises;

sensing means for detecting the pressure in said second means and said third means;

pressurizing means, responsive to said sensing means, for pressurizing said second means; and means, responsive to said sensing means, for reducing pressure in said second means if the pressure in said second means exceeds a predetermined threshold as detected by said sensing means.

15. The system of claim 9, wherein said means for coupling comprises a grappling mechanism.

16. Apparatus for delivering a cold fluid to a device to be cooled held within a cooling chamber, said chamber to be coupled to a cold fluid delivery tube which directs a stream of cold fluid to cool the device and a return tube which vents the expended cold fluid from the cooling chamber, comprising:

a. means for storing cold fluid in a manner to substantially prevent heat transfer between the cold fluid and the environment outside the means for storing, the means for storing being configured to adaptively engage one end of the cold fluid delivery tube;

b. means for securing a second end of the cold fluid delivery tube to one end of the cooling chamber configured to adaptively engage the second end of the delivery tube such that the second end of the delivery tube is positioned to deliver from the means for storing a stream of cold fluid to cool the device;

c. means for driving the cold fluid from the means for storing into the one end of the delivery tube adaptively engaged thereto so that the cold fluid is carried via the delivery tube into the cooling chamber which is adaptively engaged to the second end of the delivery tube, the second end of the delivery being positioned to direct a stream of the cold fluid to cool the device held within the chamber; and d. means for insulating the cold fluid while being carried by the delivery tube from the environment outside the delivery tube and from the return tube which vents the expended cold fluid from the cooling chamber so as to substantially prevent heat transfer between the cold fluid and the outside environment and the cold fluid and the return tube.

17. Apparatus for delivering a cold fluid to a device to be cooled held within a cooling chamber, said chamber to be coupled to a cold fluid delivery tube which directs a stream of cold fluid to cool the device and a return tube which vents the expended cold fluid from the cooling chamber, comprising:

a. a container which stores cold fluid and is configured at a first end to adaptively engage one end of the cold fluid delivery tube, said container constructed to insulate the cold fluid stored therein so as to substantially prevent heat transfer between the cold fluid and the environment outside the container, said container also constructed to withstand a predetermined amount of pressurization of the cold fluid;

b. means for securing a second end of the cold fluid delivery tube to one end of the cooling chamber configured to adaptively engage the second end of the delivery tube such that the second end of the delivery tube is positioned to deliver from the container a stream of cold fluid to cool the device;

c. means for pressurizing the cold fluid in the container so as to drive the cold fluid from the container into the one end of the delivery tube adaptively engaged thereto so that the cold fluid is carried via the delivery tube to the cooling chamber which is adaptively engaged to the second end of the delivery tube, the second end of the delivery tube being positioned to direct a stream of pressurized cold fluid to cool the device held within the chamber;

d. means for insulating the cold fluid while being carried by the delivery tube from the environment outside the delivery tube and from the return tube which vents the expended cold fluid from the cooling chamber so as to substantially prevent heat transfer between the cold fluid and the outside environment and the cold fluid and the return tube.

18. The apparatus of claim 17, wherein the means for pressurizing comprises means for regulating the amount of pressure exerted on the cold fluid within the container.

19. The apparatus of claim 17, wherein the means for pressurizing comprises means for exposing the interior of the container to the environment outside the container so as to reduce the amount of pressure exerted on the cold fluid within the container.

20. The apparatus of claim 17, further comprising:

means for opening a passage between the first end of the container and the environment outside the container upon the pressurization of the cold fluid beyond a predetermined amount of pressure.

21. The apparatus of claim 17, further comprising means for connecting the first end of the container to a passageway to the outside environment upon the pressurization of the cold fluid beyond a predetermined amount of pressure, which comprises:

a. a rigid enclosure having one end which is configured to adaptively engage the first end of the container and a lengthwise opening through its center sized and shaped for slidable passage therethrough of the one end of the delivery tube, said lengthwise opening being configured to form a channel when the delivery tube is situated therein providing passage from the interior of the container to an opening to the outside environment formed in the interior of the enclosure;

b. a rigid sliding member disposed within the enclosure coaxially surrounding the lengthwise opening and the delivery tube when the tube is situated therein, the sliding member being sized and shaped to undergo lengthwise movement along the axis of the lengthwise opening and, in its rest position, to be in intimate contact with the enclosure so as to block the channel from the container interior to the opening to the outside environment formed in the interior of the enclosure;

c. a resilient member configured to hold the sliding member in intimate contact with the enclosure and having a spring constant which forces the sliding member to stay in its rest position until overcome by a flow of cold fluid in the channel under a predetermined amount of pressure, said resilient member when overcome by such pressurized flow of cold fluid permits the sliding member to move along the axis of the lengthwise opening away from intimate contact with the enclosure so that the cold fluid can flow from the container through the unblocked channel and exit from the opening to the outside environment formed in the enclosure.

* * * * *

UNITED STATES PATENT AND TRADEMARK OFFICE

CERTIFICATE OF CORRECTION

PATENT NO. : 4,870,830

DATED : October 3, 1989

INVENTOR(S) : Gert K.G. HOHENWARTER and John A. GRANGE

It is certified that error appears in the above-identified patent and that said Letters Patent is hereby corrected as shown below:

Column 3, line 52, change "occassionally" to --occasionally--.

Column 9, line 50, after "cryogenic" insert --fluid--.

Column 9, line 52, after "fluid;" delete --second--.

Column 9, line 53, before "means" insert --second--.

Column 9, line 53, after "cooled;" delete --third--.

Column 9, line 54, before "means" insert --third--.

Column 11, line 66, after "delivery" insert --tube--.

Signed and Sealed this

Sixth Day of November, 1990

*Attest:*

HARRY F. MANBECK, JR.

*Attesting Officer*

*Commissioner of Patents and Trademarks*